US005891010A

United States Patent [19]

Kobben et al.

[11] Patent Number: 5,891,010

[45] Date of Patent: Apr. 6, 1999

[54] CUSHIONING CONVERSION MACHINE WITH SWING-MOUNTED STOCK ROLL SUPPORT AND METHOD

[75] Inventors: Pierre G. Kobben, Kerkrade; Herman R.L. Van Heumen, Heerlen, both of Netherlands

[73] Assignee: Ranpak Corp., Concord Township, Ohio

[21] Appl. No.: 766,667

[22] Filed: Dec. 12, 1996

[51] Int. Cl.[6] ..... B31B 47/00

[52] U.S. Cl. ..... 493/475; 493/464; 493/967; 242/598.2

[58] Field of Search ..... 493/464, 967, 493/477, 478, 479; 242/598.2, 598.3, 598.4; 495/477, 478, 479

[56] References Cited

U.S. PATENT DOCUMENTS

| | | | |
|---|---|---|---|
| 2,466,957 | 1/1949 | Lewis | 242/598.2 |
| 2,517,809 | 8/1950 | Tarzian | 242/598.2 |
| 2,733,017 | 1/1956 | Chrzanowski | 242/598.2 |
| 3,096,039 | 7/1963 | Doven | 242/598.2 |
| 3,823,887 | 7/1974 | Gerstein | 242/598.2 |
| 4,085,671 | 4/1978 | Gates | 242/598.2 |
| 4,557,716 | 12/1985 | Ottaviano | 493/477 |
| 4,858,274 | 8/1989 | Harrison . | |
| 5,042,272 | 8/1991 | Furr | 242/598.2 |
| 5,136,859 | 8/1992 | Nitta | 242/598.2 |
| 5,367,071 | 11/1994 | Simmons | 493/464 |

FOREIGN PATENT DOCUMENTS 9013414A 11/1990 WIPO .

*Primary Examiner*—John Sipos
*Assistant Examiner*—Christopher W. Day
*Attorney, Agent, or Firm*—Renner, Otto, Boisselle & Sklar, P.L.L.

[57] ABSTRACT

A novel stock roll support assembly and loading method for a cushioning conversion machine that produces dunnage product from sheet stock material supplied as a roll provides for easier loading of the stock roll onto a roll support at the upstream end of the cushioning conversion machine in certain situations, such as where the machine is located against a wall or over (or under) a conveyor, etc. The stock roll support assembly is connected to a main frame of the machine for rotatably supporting a roll of sheet stock material. The stock roll support assembly includes a stock roll support mounted to the main frame for swinging movement between an operating position and a loading position. In the operating position, the stock roll support is operative to support the stock roll adjacent the main frame, and in the loading position, the stock roll support is swung away from the main frame to facilitate loading of a stock roll thereon.

17 Claims, 10 Drawing Sheets

CUSHIONING CONVERSION MACHINE WITH SWING-MOUNTED STOCK ROLL SUPPORT AND METHOD

FIELD OF THE INVENTION

The invention herein described relates generally to a cushioning conversion machine and method for producing resilient pad-like dunnage product from sheet stock material supplied in roll form and, more particularly, to an improved device and method for facilitating the loading of a roll of stock material for use by the cushioning conversion machine.

BACKGROUND OF THE INVENTION

In the process of shipping an item from one location to another, a protective packaging material is typically placed in a shipping case, or box, to fill any voids and/or to cushion the item during the shipping process. Some conventional protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alternative. Paper is biodegradable, recyclable and composed of a renewable resource, making it an environmentally responsible choice for conscientious industries.

While paper in sheet form could possibly be used as a protective packaging material, it is usually preferable to convert sheets of paper into a pad-like or other dunnage product. This conversion may be accomplished by a cushioning conversion machine, such as that disclosed in commonly assigned U.S. Pat. No. 4,968,291. The therein disclosed cushioning conversion machine converts sheet stock material, such as paper in multi-ply form, into a pad-like dunnage product having longitudinally extending pillow-like portions that are connected together along a stitched central portion of he product. The stock material generally consists of three superimposed webs or layers of biodegradable, recyclable and reusable thirty-pound Kraft paper. A thirty-inch wide roll of this paper, which is approximately 450 feet long, will weigh about 35 pounds and will provide cushioning equal to approximately four fifteen cubic foot bags of plastic foam peanuts while at the same time requiring less than one-thirtieth the storage space.

The multi-ply roll of sheet stock material is mounted, for example, on an axle or a spindle that passes through the core of the stock roll with its ends projecting therebeyond for cradled receipt in respective laterally spaced apart mounts of a roll support member. The mounts may be provided, for example, directly on the frame of the cushioning conversion machine as shown in the '291 patent or on a mobile cart as shown in commonly assigned U.S. Pat. No. 4,650,456.

The stock rolls presently used in cushioning conversion machines of the foregoing type have a 3 inch (7.62 cm) cardboard core tube around which multiple plies of the sheet material are tightly wrapped. A common practice has been to insert into each end of the core tube a disposable plastic plug that accommodates a difference between the inner diameter of the core tube and the outer diameter of the axle or spindle used to support the stock roll at the upstream end of the cushioning conversion machine. The plastic plugs in use today have concentric cylindrical outer and inner walls that are interconnected by an axially inner annular wall and radial ribs that extend radially between the radially inner and outer walls. The radially outer wall is sized for close fitted insertion into the core tube of the stock roll and there is provided at the axially outer end thereof a radially projecting annular flange which functions to engage the end of the core tube to prevent over-insertion of the plug into the core tube. The radially inner cylindrical wall has an inner diameter closely corresponding to the outer diameter of the spindle for smooth rotation of the plug about the spindle.

The stock roll would typically be loaded by positioning the stock roll on the floor or on a stand near the cushioning conversion machine. The spindle would then be inserted into the center hole in the plug at one end of the roll, through the core tube and then through the center hole in the plug at the opposite end of the roll. The stock roll could then be raised by grasping and lifting the ends of the spindle that project from opposite ends of the stock roll. The loading operation is completed by lowering the projecting ends of the spindle onto the laterally spaced apart mounts that have recesses for cradled receipt and retention of the spindle.

In certain packaging situations, circumstances may require the cushioning conversion machine to be placed against a wall, or over or under a conveyor or packaging table. In such situations it may be difficult or even impossible to load the stock roll on the machine. When a machine is placed against a wall, there may be insufficient room for the spindle to extend beyond the mounts or it may be difficult for an individual to fit between the machine and wall to lift one end of the stock roll onto the machine. Similarly, where a machine is disposed above or below a conveyor or a packaging table, the table or the conveyor may prevent a person from standing at the stock supply end of the machine to load the stock roll thereon. The stock rolls are generally light enough for one person to lift, but generally heavy enough to be cumbersome for lifting while reaching across a conveyor or table. To avoid reaching, two people are needed to lift the stock roll. Accordingly, it would be desirable to provide an improved system for facilitating the loading of a stock roll in those situations where conventional loading practices can not be performed easily, if at all.

SUMMARY OF THE INVENTION

The present invention provides a novel stock roll support assembly and loading method for a cushioning conversion machine that produces dunnage product from sheet stock material supplied as a roll. The assembly and loading method provide for easier loading of the stock roll onto a roll support at the upstream end of the cushioning conversion machine in certain situations, such as where the machine is located against a wall, over (or under) a conveyor, etc.

According to the present invention, a cushioning conversion machine comprises a stock roll support assembly that is connected to a main frame of the machine for rotatably supporting a roll of sheet stock material. The stock roll support assembly includes a stock roll support mounted to the main frame for swinging movement between an operating position and a loading position.

In the operating position, the stock roll support is operative to support the stock roll adjacent the main frame, and in the loading position, the stock roll support is swung away from the main frame to facilitate loading of a stock roll thereon.

In a preferred embodiment of the invention, the stock roll support is pivotally connected to the main frame. The support frame has mounted thereon a pair of laterally spaced apart mounts for supporting an axle or other form of spindle on which the stock roll can be rotatably supported between the mounts.

The support frame also preferably has mounted thereon a constant entry roller and a separating mechanism for separating multiple plies of the sheet stock material. The cushioning conversion machine also preferably includes a retainer mechanism such as a latch, for releasably retaining the stock roll support in the operating position.

Further in accordance with a preferred embodiment, the support frame includes side frame members defining therebetween a rectangular window for passage of the sheet stock material therethrough. The main frame includes a rectangular opening at its upstream end or end plate, and the rectangular window is coincident with the rectangular opening when the stock roll support is in the operating position.

According to another preferred embodiment of the invention, the stock roll support includes a spindle for rotatably supporting the roll of sheet stock material. One end of the spindle is connected by a swing mount to the main frame for swinging movement. Preferably, there is provided a support mount on the main frame for releasably supporting an opposite end of the spindle when the stock roll support is in the operating position. The support mount and the swing mount project from the main frame in a laterally spaced apart parallel relationship. The spindle has thereon at least one bearing for rotatably supporting the stock roll.

According to a further aspect of the invention, the cushioning conversion machine is mounted either above or below the conveyor. In this configuration, the stock roll support is swingable from its operating position at which the stock roll support extends transversely across the conveyor to its loading position at which the stock roll support extends parallel to the conveyor.

The invention also provided a method for loading and supporting a stock roll in operative relation to a cushioning conversion machine for producing a dunnage product from sheet stock material payed off of the stock roll. The method comprises the steps of swinging a stock roll support on the machine away from the machine to a loading position; loading a stock roll onto the stock roll support; and swinging the stock roll support back toward the machine to an operating position adjacent the machine. Preferably, the method further comprises the step of using a retainer mechanism to hold the stock roll support in the operating position during operation of the machine. Also, the stock material preferably is biodegradable, recyclable and composed of a renewable resource.

The foregoing and other features of the invention are hereinafter fully described and particularly pointed out in the claims, the following description and the annexed drawings setting forth in detail certain illustrative embodiments of the invention, such being indicative, however, of but one or a few of the various ways in which the principles of the invention may be employed.

DETAILED DESCRIPTION OF THE INVENTION

Figure 1:
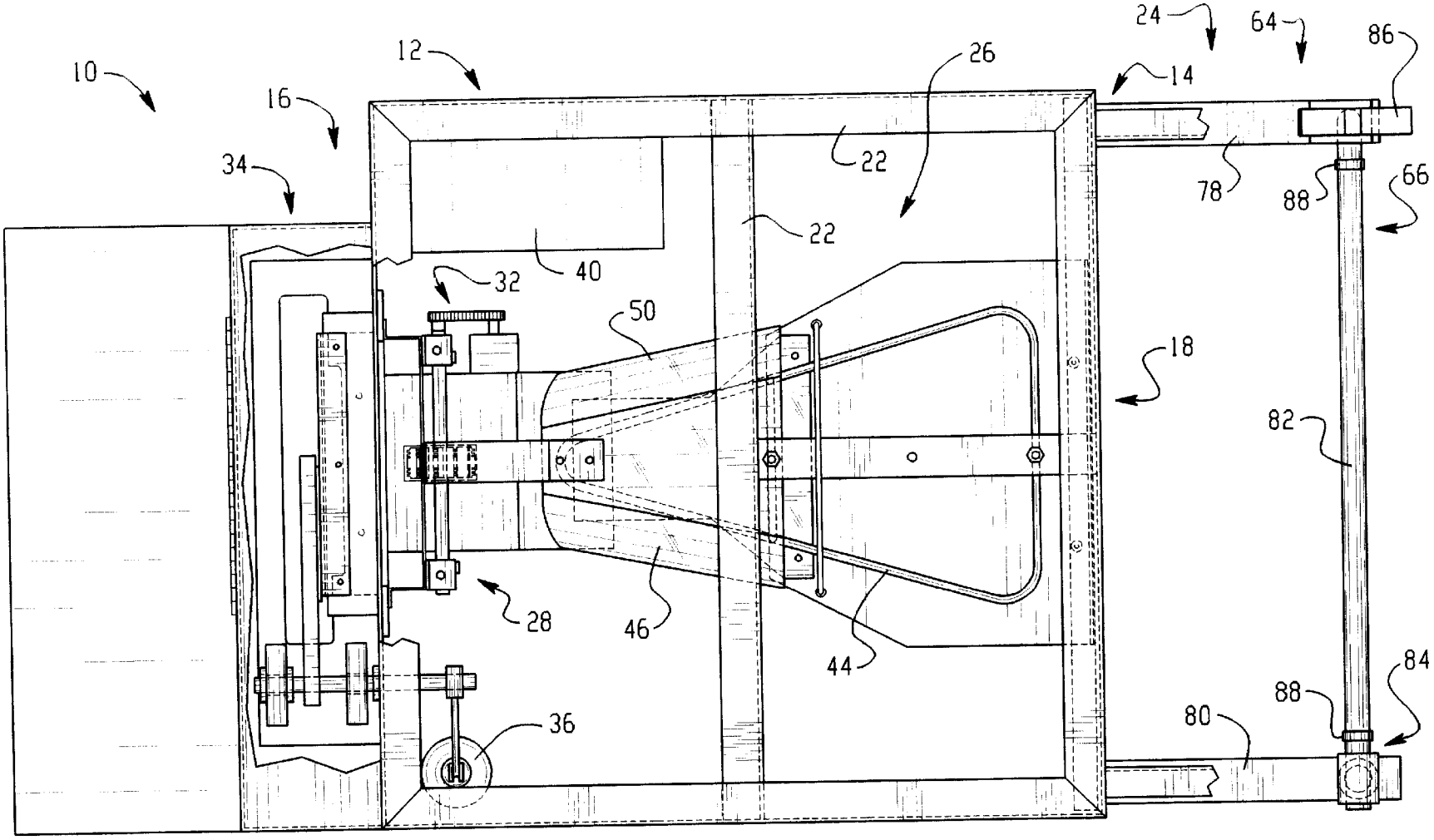
FIG. 1 is a partially cut-away schematic top view of a cushioning conversion machine including a stock supply assembly according to the present invention.
Figure 2:
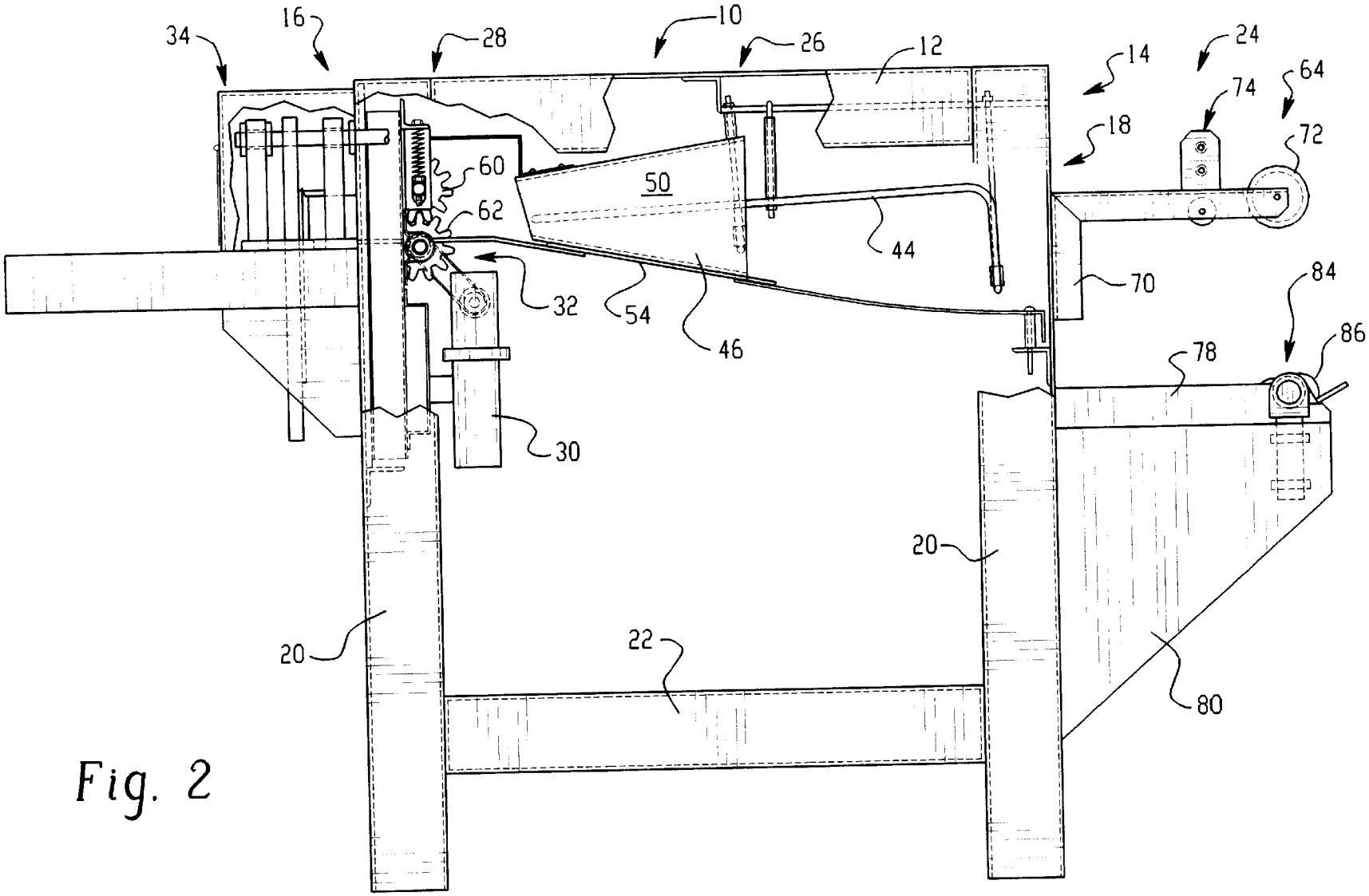
FIG. 2 is a partially cut-away schematic side view of the cushioning conversion machine of FIG. 1.

Referring now to the drawings in detail and initially to FIGS. 1 and 2, a preferred embodiment of a cushioning conversion machine according to the present invention is designated generally by reference number 10. The cushioning conversion machine 10 converts a sheet-like stock material, such as one or more layers of recyclable and reusable Kraft paper, into a dunnage product having, for example, lateral pillow-like portions separated by a thin central band. The dunnage product is used as an environmentally responsible protective packaging material typically used during shipping.

The machine 10 includes a housing, indicated generally at 12, having an upstream end 14 and a downstream end 16. The sheet-like stock material enters the housing 12 through an opening 18 at the upstream end thereof for passage through the housing where it is converted into a strip of cushioning that exits from the downstream end 16 of the housing. The housing includes a main frame having vertical members (or upright legs) 20 and horizontal members 22 for supporting the various components of the machine 10.

The machine 10 further includes a stock supply assembly 24, a former or forming assembly 26, a feeding/connecting assembly 28 powered (energized) by a feed motor 30, for example an electric motor, through a motion transfer assembly 32, and a severing assembly 34 (for example a cutting assembly) powered by suitable means, such as the illustrated solenoid 36; all of which may be mounted to and/or in the housing/main frame 12 in a well known manner. The operation of the machine may be controlled by a controller 40, also in a well known manner.

There may also be provided downstream of the severing assembly 34 a guide assembly, and more particularly a post-cutting constraining assembly (not shown). As will be apparent, other types of severing assemblies may be employed, such as those disclosed in commonly owned U.S. Pat. Nos. 4,669,609 and 5,123,889. Also, other types of conversion assemblies may be employed for converting the sheet material to a three-dimensional shape of dunnage that is cut to length by the severing assembly.

The illustrated exemplary forming assembly 26 includes a forming member 44, in particular a forming frame, and a converging shaping chute 46. The forming assembly 26 causes an inward rolling or folding of the lateral edges of the sheet-like stock material to form a continuous strip of cushioning having lateral pillow-like portions. The shaping chute 46 includes longitudinally extending, transversely converging side walls 50 which preferably are curved or arcuate in transverse cross-section. As the sheet-like stock material is passed through the shaping chute 46, the side edges thereof are rolled inwardly and are urged inwardly toward one another so that the inwardly rolled edges form resilient pillow-like crumpled portions of stock material disposed in lateral abutting relationship as they emerge from the exit end of the shaping chute. The forming member 44 coacts with the shaping chute 46 to ensure proper shaping and forming of the paper (or other suitable stock material), the forming member being operative to guide the central portion of the stock material along the bottom wall 54 of the shaping chute 46 for controlled inward rolling or folding of the side edge portions of the stock material. The forming member 44 projects rearwardly (upstream) of the entry end of the shaping chute for proper guiding of the stock material into the shaping chute. The forming member also extends into the shaping chute with its forward most end disposed relatively close to the underlying bottom wall 54 of the shaping chute adjacent the exit end of the shaping chute, as shown.

The invention likewise encompasses different types of feeding/connecting assemblies which perform a feeding and/or connecting function. However, a preferred feeding/connecting assembly 28 includes a pair of cooperating and opposed gears or gear-like members 60 and 62. The gears 60 and 62, and thus the feeding/connecting assembly 28, perform at least one and preferably two functions in the operation of the machine 10. One function is a "feeding" function, the gears pulling the stock material from a stock roll or other source thereof and then through the forming assembly 26. The material is then discharged by the feeding/connecting assembly 28 to the severing assembly 34. The second function preferably performed by the feeding/connecting assembly 28 is a connecting function. Specifically, the feeding/connecting assembly 28 connects the continuous strip by the two opposing gears 60 and 62 coining the formed stock material along a central band to form a connected strip of cushioning. Other mechanisms may be employed to "connect" the strip, i.e., to operate on the strip in such a manner that it will retain its cushioning properties as opposed to reverting to the original flat form of the stock material. Known connecting mechanisms include mechanisms that crease the stock material to enable the stock material to hold its three-dimensional shape.

The connected strip travels downstream from the feeding/connecting assembly 28 to the severing assembly 34 which severs, for example by cutting, the strip into a section of a desired length. The cut section then may travel through a post-cutting constraining assembly such as in the manner described in commonly owned U.S. Pat. No. 5,123,889, which includes a converging portion and rectangular tunnel portion. The coined or otherwise connected strip then emerges from the post-cutting constraining assembly where an operator may remove the coined strip from the machine 10.

The stock supply assembly 24 comprises a stock roll support assembly 64 that in turn includes a stock roll support 66 and suitable means for mounting the stock roll support for swinging movement from an operating position to a loading position. The stock supply assembly 24 further includes a pair of L-shaped brackets 70 turned on their sides with the shorter portions thereof secured to respective upright legs 20 of the housing 12. These brackets 70 have journalled between the ends thereof a constant entry roller 72 that provides a non-varying point of entry for the sheet stock material from the stock roll. The brackets 70 also preferably support therebetween a separating mechanism 74 which receives the sheet stock material from the roller 72 and separates the multiple plies from one another prior to passing beneath the forming member 44 and into the shaping chute 46. For further details concerning the constant entry roller 72 and separating mechanism 74, reference may be had to U.S. Pat. No. 4,750,896.

Figure 6:
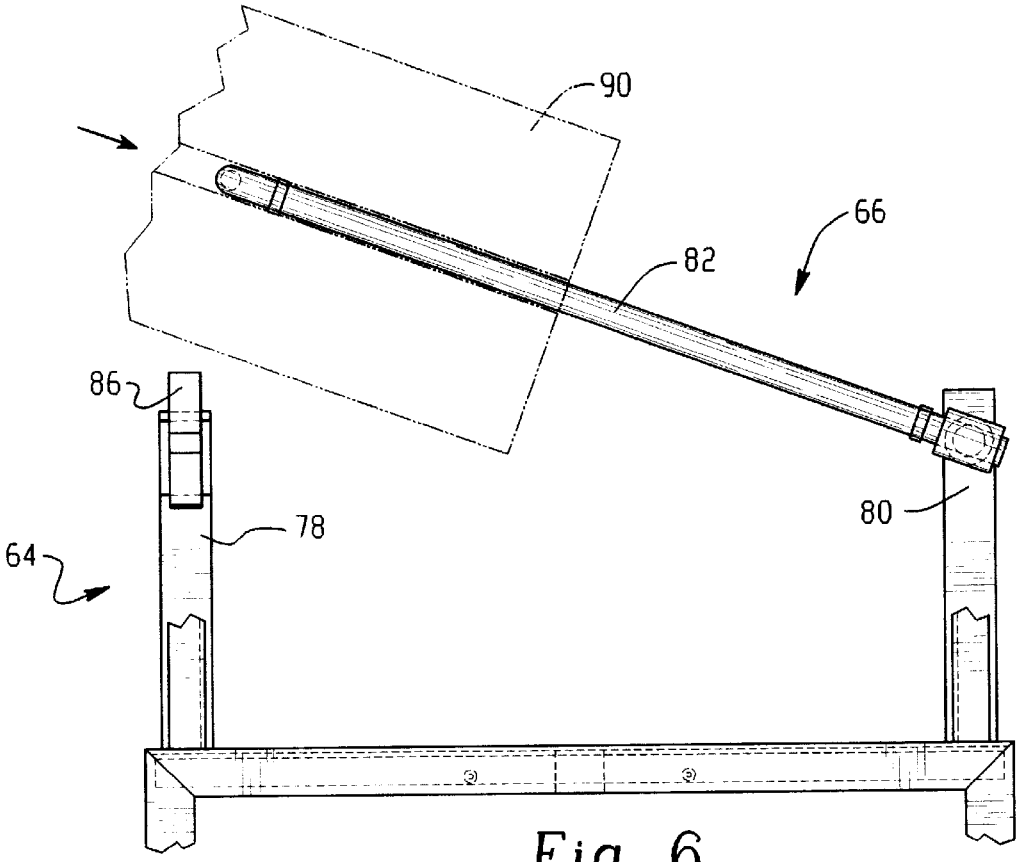
Figure 7:
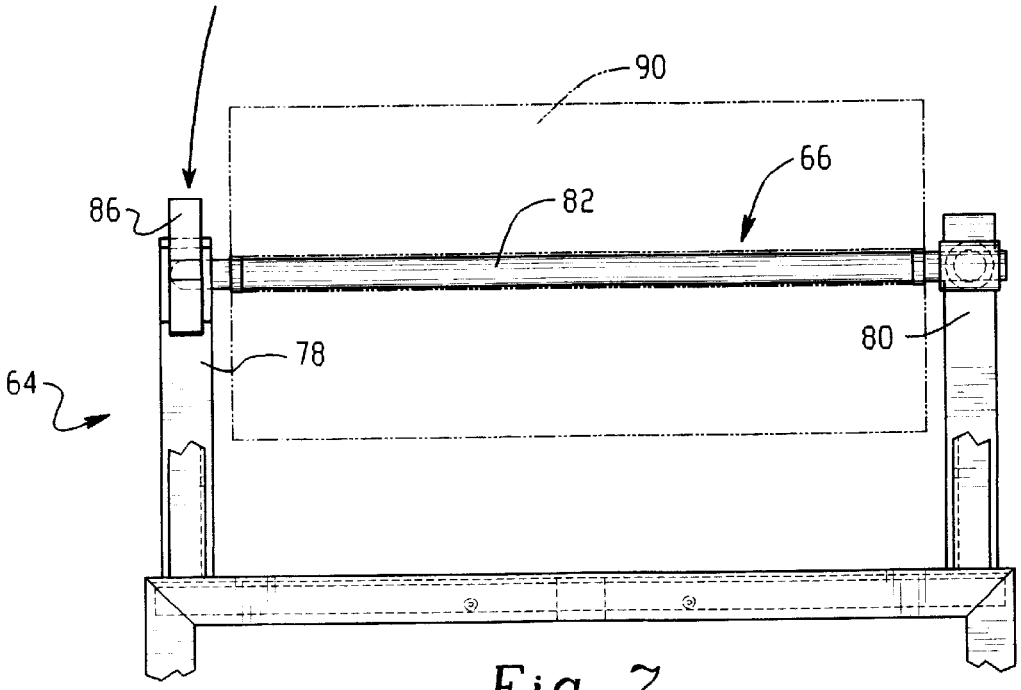

The stock roll support assembly 64 further includes a support mount 78 laterally spaced apart from a swing mount 80 for supporting the stock roll support 66, which includes a spindle 82. One end of the spindle 82 is pivotally mounted to the swing mount 80 for swinging movement between an operating position (FIGS. 1 and 2) and a loading position (FIG. 6). The distal or free end of the spindle 82 is supported and carried on the support mount 78 in the operating position illustrated in FIGS. 1 and 2. The stock roll support 66 or spindle 82 is pivotally supported on the swing mount 80 by a pivot joint 84 for pivotal rotation thereabout. Alternatively, any other type of joint which allows the spindle to swing from the operating position to the loading position may be used.

In the operating position, the free end of the spindle 82 is supported by the support mount 78 and is held in place by a cam latch 86. Operation of the cam latch 86 is discussed below with respect to a method of loading a stock roll according to the invention. Alternatively, any other type of latch, such as, for example, a ratchet-like latch or a latch including a pin and a spring-biasing means may be used to releasably retain the spindle in an operating position when the machine is operating to convert sheet stock material into a three-dimensional cushioning product.

The spindle 82 includes a pair of laterally spaced apart bearings 88 for rotatably supporting the hollow center or core of the stock roll. The hollow core of the stock roll may be formed, for example, by a cardboard core tube or by the innermost turns of stock material in the stock roll that does not employ a core tube. A typical core tube diameter is approximately 3 inches (7.62 cm), but other diameters of core tubes or cores are also contemplated.

As an alternative to the bearings 88, a pair of core inserts configured for close fitted receipt within the ends of the hollow core of the stock roll may be employed. Axial stops for limiting axial movement of the stock roll relative to the spindle 82 may also be employed. None of the above additions to the spindle 82 are mandatory, however, and the stock roll may rest on the bare spindle 82 without either axial stops or bearings.

Figure 3:
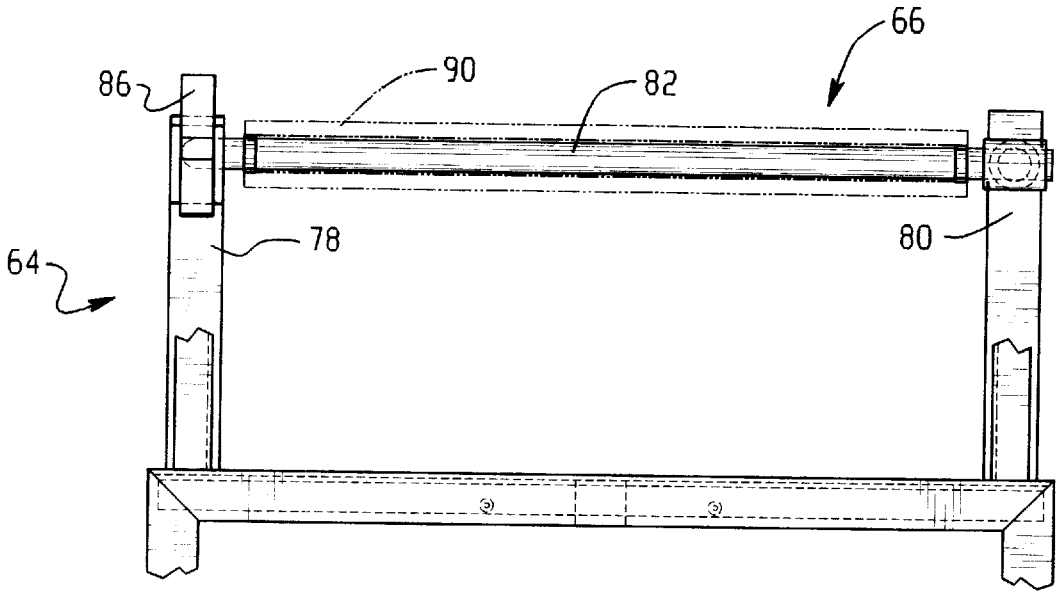
FIGS. 3–7 are schematic top views of the stock supply assembly of FIGS. 1 and 2, sequentially illustrating a loading method according to the invention.
Figure 4:
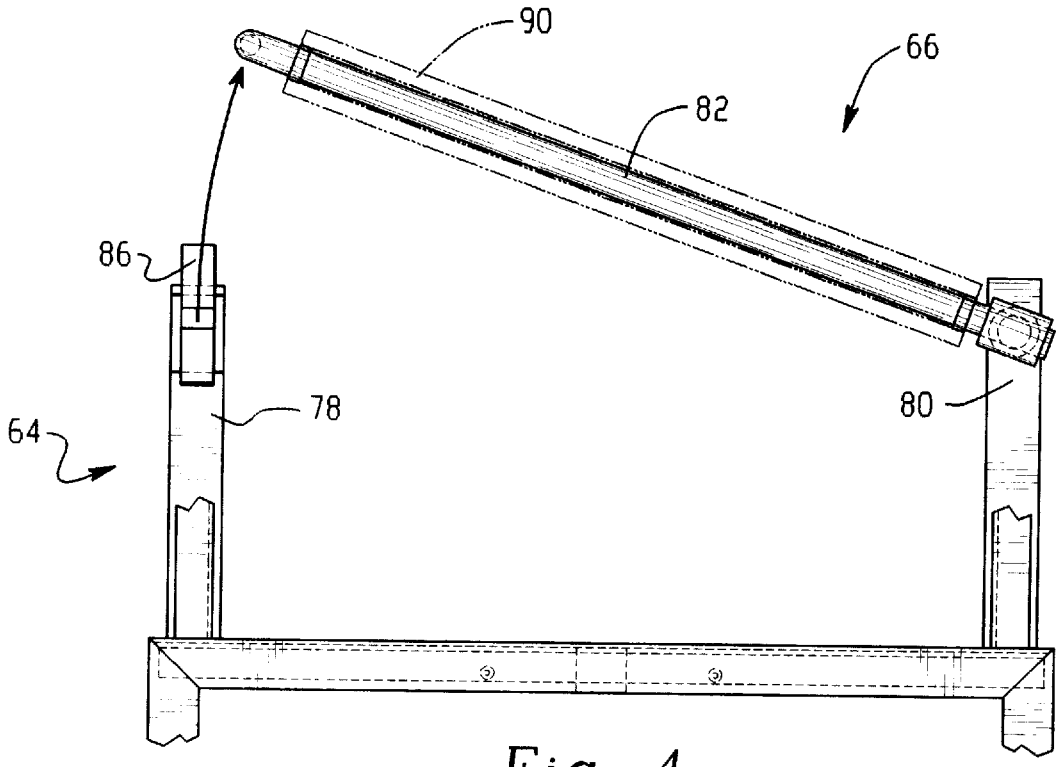
Figure 5:
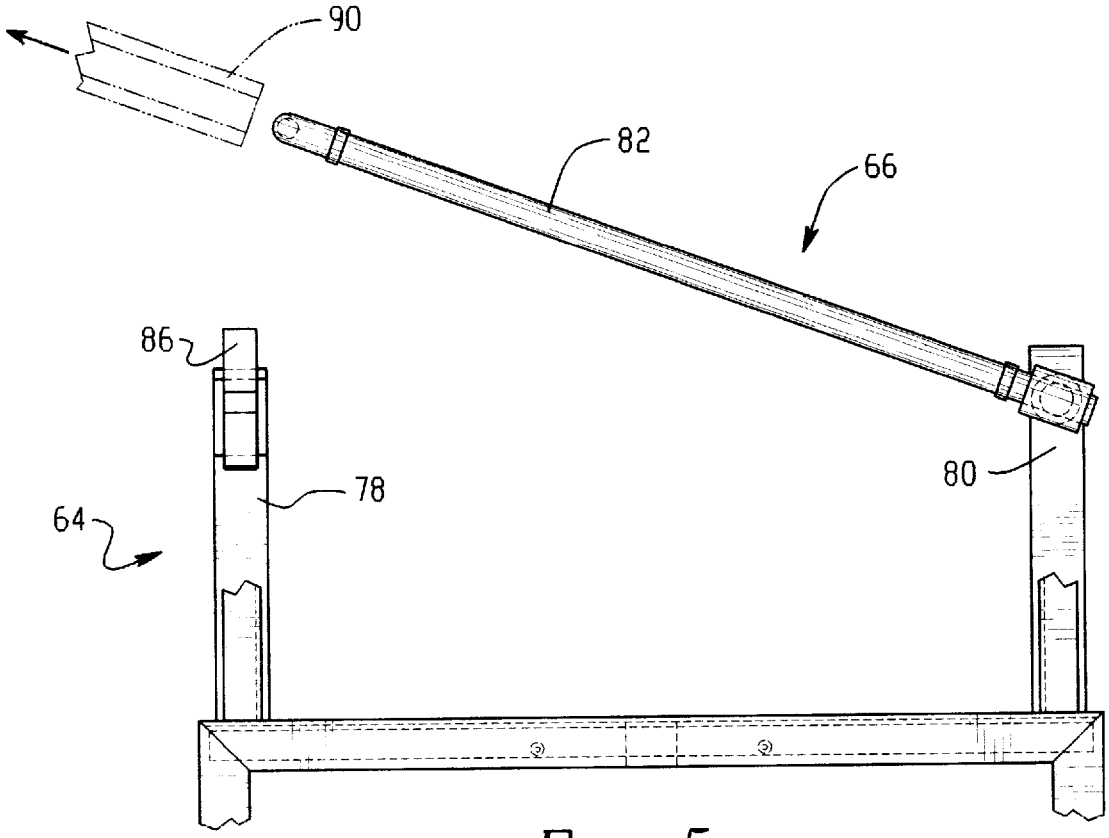

A method of loading a stock roll 90 onto the stock roll support assembly 64, in operative relation to a cushioning conversion machine 10, is sequentially illustrated in FIGS. 3–7. When a stock roll 90 is spent as shown in FIG. 3, the latch 86 is lifted to allow the stock roll support 66 to swing clear of the support mount 78, i.e., from the operating position to the loading position, locating the free end of the spindle 82 away from the machine 10 clear of the support mount 78. Once the stock roll support 66 is rotated or swung to the loading position the core (if used) of the stock roll 90 may be removed as shown in FIG. 5. Then, as shown in FIG. 6, a new stock roll 90 may be telescopically loaded over the spindle 82. The stock roll support 66 and stock roll 90 supported thereon may then be swung back to the operating position. The latch 86 engages the spindle 82 as it swings from the loading position to the operating position, then rides up and over the spindle 82 so as to releasably secure and retain the spindle 82 in the operating position. The stock roll 90 then will be ready to have the stock material unwound therefrom and the plies of stock material separated for passage through the separating mechanism 74 followed by conversion to a pad-like cushioning dunnage product by the cushioning conversion machine 10.

Because the spindle 82 will swing or pivotally rotate away from the operating position, it is much easier for an operator to load the stock roll 90 onto the spindle 82 and the stock support assembly 64 when the machine 10 is located, for example, above (or below) a conveyor or table, or against a wall.

Figure 11:
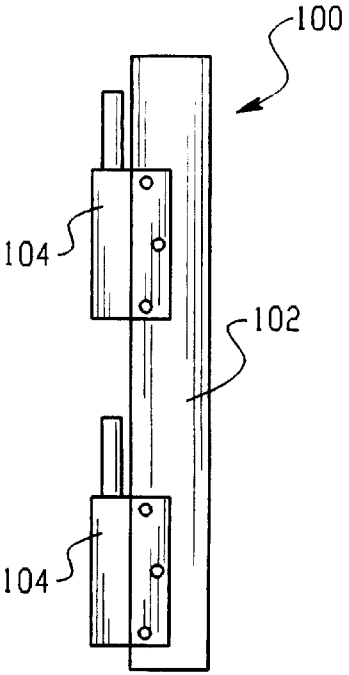
FIG. 11 is a side edge view of the support frame of FIG. 10.
Figure 13:
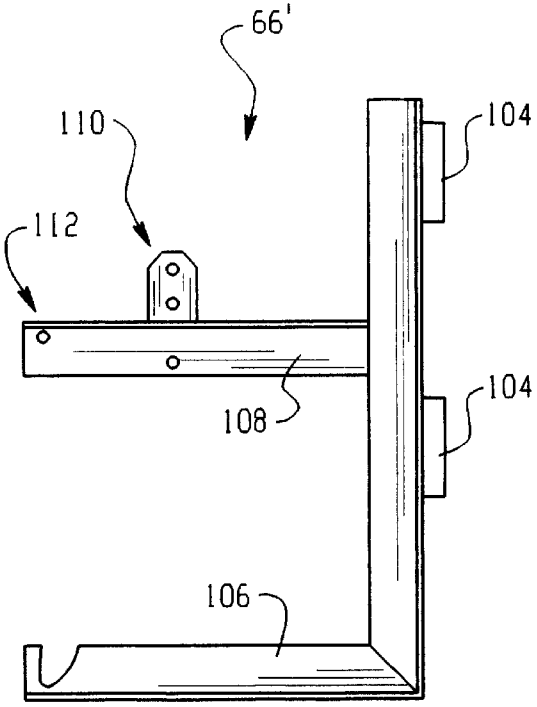
FIG. 13 is a side view view of the stock roll support of FIG. 12.
Figure 12:
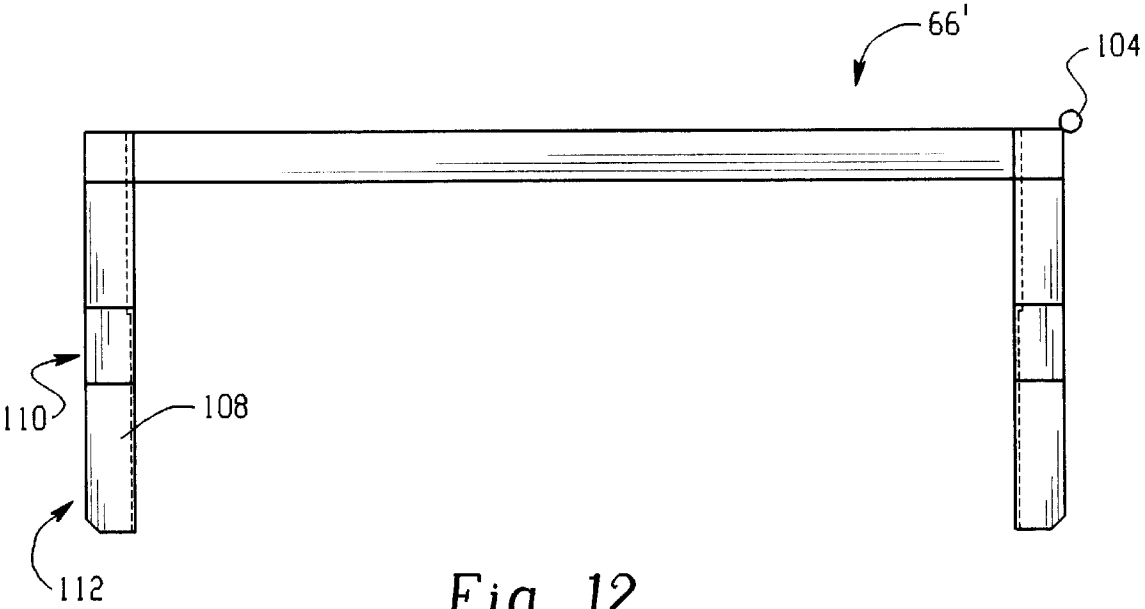
FIG. 12 is top view of the stock roll supporr shown in FIG. 9.
Figure 14:
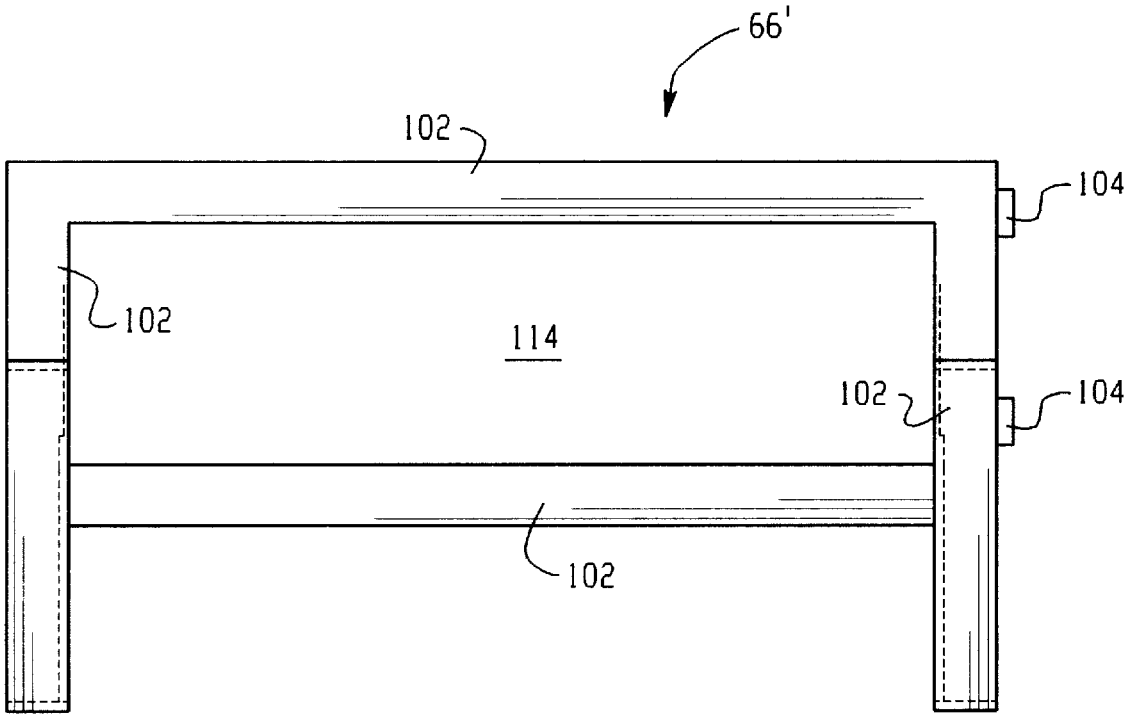
FIG. 14 is a rear view of the stock roll support of FIG. 12.

According to another embodiment of the present invention shown in FIGS. 8–14, a stock supply assembly 24' has a stock roll support assembly 64' which includes a stock roll support 66', a support frame 100 and means for mounting the stock roll support 66' for swinging movement between an operating position and a loading position. Components of the stock roll support assembly 66' are shown in FIGS. 10–14, including the support frame 100 (FIGS. 10–11) and the stock roll support 66' (FIGS. 12–14).

Figure 9:
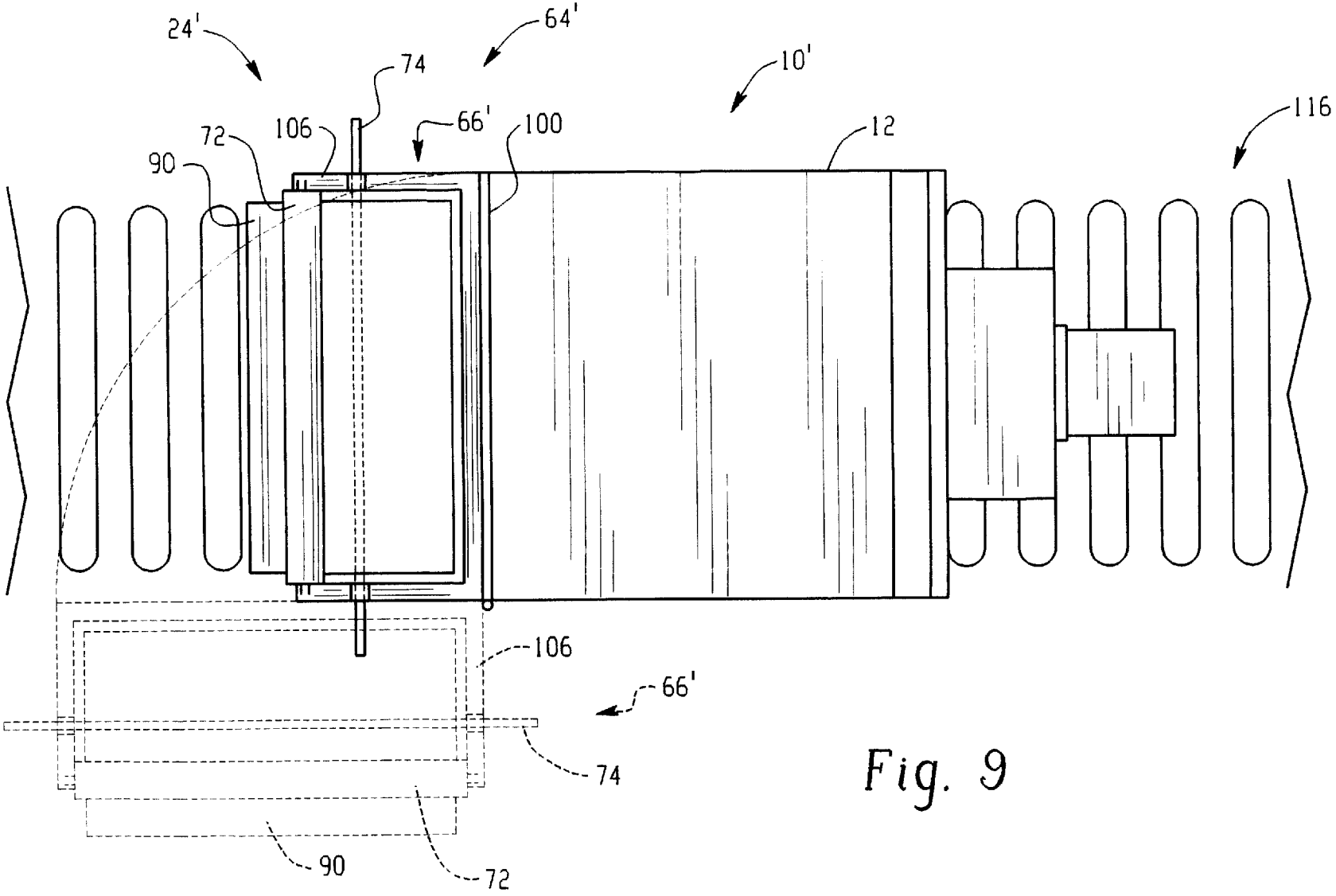
FIG. 9 is a top view of the cushioning conversion machine of FIG. 8 showing a stock roll support of the stock supply assembly in an operating position in solid lines and in a loading position is broken lines.
Figure 10:
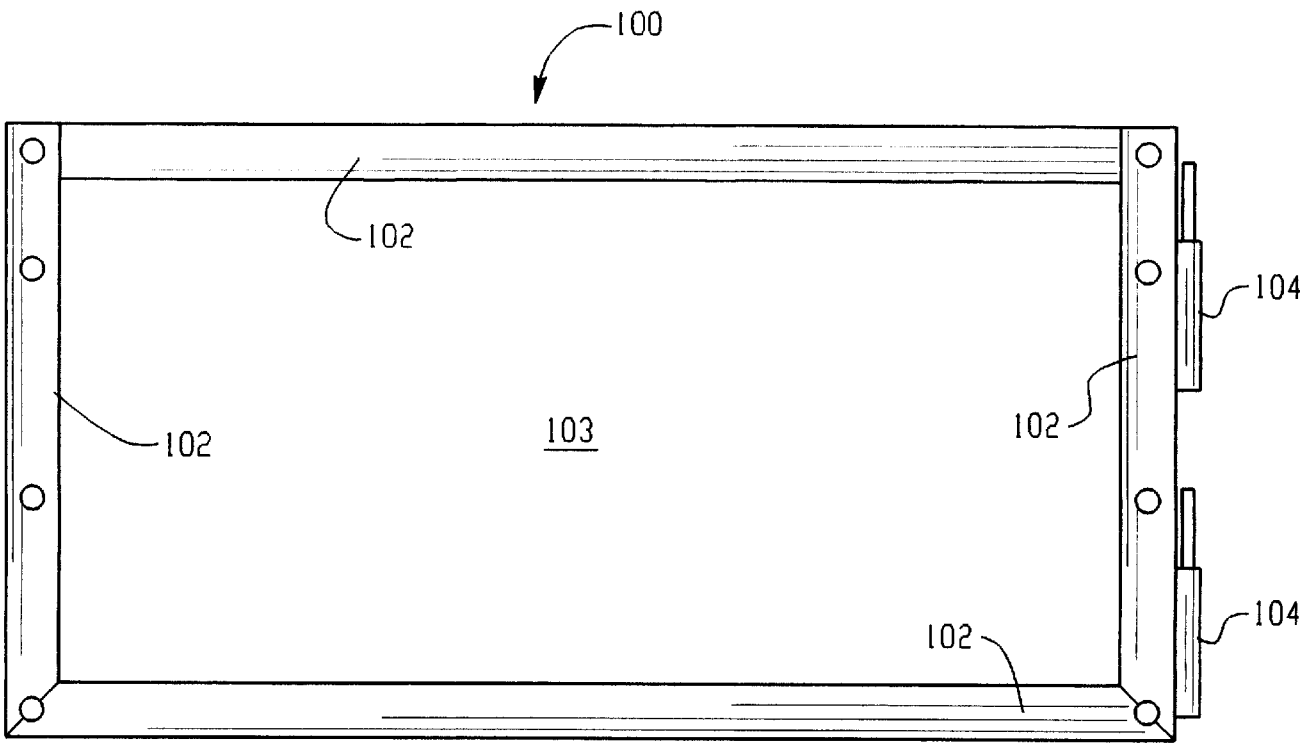
FIG. 10 is a rear view of a support frame used in the stock supply assembly of FIG. 9.

The support frame 100, shown in FIGS. 10 and 11, may be secured by suitable means to the housing 12' (FIGS. 8 and 9) or may be integral with the housing. The support frame 100 may be used to retro-fit existing cushioning conversion machines or provide additional reinforcing structure to the upstream end 14 or end plate of the housing 12. The support frame 100 includes side frame members 102 defining therebetween a rectangular window 103 for passage of the sheet stock material therethrough to the rectangular opening in the upstream end or end plate of the housing and further to a forming assembly in the machine 10'. The support frame 100 has connected thereto the stock roll support 66' for swinging movement between an operating position and a loading position by lift-off hinges 104, thereby enabling the stock roll support 66' to be removed easily from the machine 10, although other types of devices, such as other hinges and pivot joints may be used.

The stock roll support 66', shown in FIGS. 12–14, includes a pair of laterally spaced apart mounts 106 which accept a conventional axle for supporting the stock roll. Preferably, a separating mechanism and constant entry roller (not shown in FIGS. 12–14) may be mounted via a pair of laterally spaced apart brackets 108 on the stock roll support 66' for swinging movement therewith at positions 110 and 112, respectively. As shown in FIG. 14, side frame members 102 define therebetween a rectangular window 114 corresponding to the rectangular window 103 formed in the support frame 100 for passage therebetween of the sheet stock material.

Figure 8:
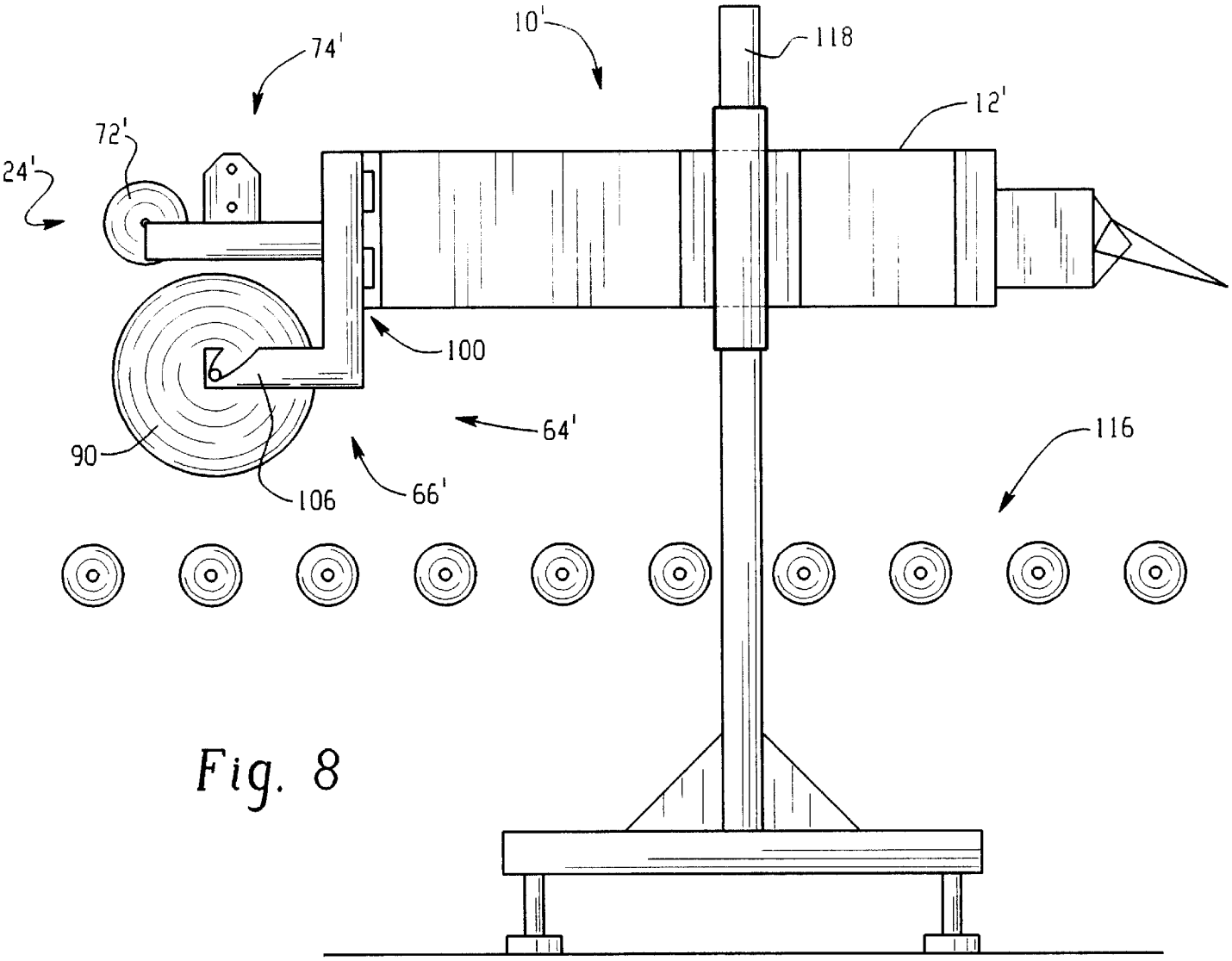
FIG. 8 is a side view of another cushioning conversion machine employing another embodiment of stock supply assembly according to the invention.

Reverting to FIGS. 8 and 9, the cushioning conversion machine 10' is located above a conveyor 116 on a stand 118. Although not shown in FIGS. 8 and 9, the machine 10' includes conversion assemblies including in particular a forming assembly and a pulling/connecting assembly, and also a severing assembly. Further details of exemplary internal assemblies and components of the machine 10' can be found in U.S. Pat. No. 5,123,889, which is hereby incorporated herein by reference in its entirety.

For loading a stock roll 90 onto the cushioning conversion machine 10', the stock roll support 66' is swung away from the machine 10' to the loading position shown in broken lines. At this position, the mounts 106 are disposed to the side of the conveyor 116 and provide for easier loading of a new stock roll 90 thereon. An empty spindle may be removed and telescopically inserted into a fresh stock roll. The stock roll 90 is then loaded onto the mounts 106.

The sheet stock material may also be fed over the constant entry roller 72' and multi-ply stock material threaded through the separating mechanism 74' while the stock roll support 66' is in the loading position. The ends of the plies of stock material may be folded together into the conventional triangular shape for feeding through the former. The stock roll support 66' may then be swung back into the operating position (solid lines) for feeding the triangular shaped end of the stock material into the housing, the forming assembly, and the feeding/connecting assembly, for forming a three-dimensional cushioning product from the sheet stock material. This embodiment provides the advantage of being able to thread multi-ply stock material through the separating mechanism 74' before the stock roll support 66' is swung into the operating position, thereby relieving the operator of having to reach across the conveyor 116 in order to do so.

The stock roll support assembly 64' may also be provided on a machine which is in a vertical orientation, thereby providing similar advantages.

Although the invention has been shown and described with respect to a certain preferred embodiment or embodiments, it will be apparent that equivalent alterations and modifications will occur to others skilled in the art upon the reading and understanding of this specification and the annexed drawings. In particular regard to the various functions performed by the above described numerals (components, assemblies, devices, compositions, etc.), the terms (including a reference to a "means") used to describe such numerals are intended to correspond, unless otherwise indicated, to any integer which performs the specified function of the described numeral (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application. Accordingly, the present invention is limited only by the scope of the following claims.

What is claimed is:

1. In a cushioning conversion machine, a stock roll support assembly connected to a main frame of the machine for rotatably supporting a roll of sheet stock material, the stock roll support assembly including a stock roll support frame mounted to the main frame for swinging movement about an axis perpendicular to a rotational axis of the roll of sheet stock material on the stock roll support assembly between an operating position and a loading position, the stock roll support frame in the operating position being operative to support the stock roll adjacent the main frame, and the stock roll support frame in the loading position being swung away from the main frame to facilitate loading a stock roll thereon;

wherein the stock roll support frame include a pair of laterally spaced apart mounts for supporting opposite ends of a stock roll spindle on which the stock roll can be rotatably supported between the units.

2. A cushioning conversion machine as set forth in claim 1, further including a retainer mechanism for releasably retaining the stock roll support frame in the operating position.

3. A cushioning conversion machine as set forth in claim 2, wherein the retainer mechanism includes a latch.

4. A cushioning conversion machine as set forth in claim 1, wherein the stock roll support frame is pivotally connected to the main frame.

5. A cushioning conversion machine as set forth in claim 4, further comprising a constant entry roller mounted to the stock roll support frame.

6. A cushioning conversion machine as set forth in claim 5, further comprising a separating mechanism mounted to the stock roll support frame for separating the plies of the sheet stock material passing therebetween.

7. A cushioning conversion machine as set forth in claim 1, wherein the stock roll support frame is mounted to the main frame by at least one lift-off hinge.

8. A cushioning conversion machine as set forth in claim 1, in combination with a packaging surface, the machine being mounted adjacent the packaging-surface, and the stock roll support frame being swingable from its operating position at which the stock roll support extends transversely across the packaging surface to Its loading position at which the stock roll support frame extends parallel to the packaging surface.

9. A cushioning conversion machine as set forth in claim 8, wherein the packaging surface is formed by a conveyor.

10. A cushioning conversion machine as set forth in claim 8, wherein the packaging surface is formed by a table.

11. In a cushioning conversion machine, a stock roll support assembly connected to a main frame of the machine for rotatably supporting a roll of sheet stock material, the stock roll support assembly including a stock roll support mounted to the main frame for swinging movement between an operating position and a loading position, the stock roll support in the operating position being operative to support the stock roll adjacent the main frame, and the stock roll support in the loading position being swung away from the main frame to facilitate loading a stock roll thereon wherein the stock roll support includes a pair of laterally spaced apart mounts for supporting a spindle on which the stock roll can be rotatably supported between the mounts, wherein the stock roll support includes a support frame on which the laterally spaced apart mounts are supported and the support frame is pivotally connected to the main frame, and wherein the support frame includes side frame members defining therebetween a rectangular window for passage of the sheet stock material therethrough.

12. A cushioning conversion machine as set forth in claim 11, wherein the main frame includes a rectangular opening at its upstream end, and the rectangular window is coincident with the rectangular opening when the stock roll support is in the operating position.

13. A method for loading and supporting a hollow center stock roll in operative relation to a cushioning conversion machine for producing a dunnage product from sheet stock material payed off of the stock roll, comprising the steps of:

swinging a stock roll support frame on the machine about an perpendicular to a rotational axis of the stock roll on the stock roll support frame away from the machine to a loading position;

loading a stock roll onto the stock roll support frame; and swinging the stock roll support frame about the perpendicular axis back toward the machine to an operating position adjacent the machine;

wherein the stock support frame includes a pair of laterally spaced part mounts for supporting opposite ends of a stock roll spindle on which the stock roll can be rotatable supported between the mounts.

14. A method as set forth in claim 13, further comprising the step of using, a retainer mechanism to hold the stock roll support frame in the operating position during operation of the machine.

15. A method as set forth in claim 13, further comprising the step of separating multiple plies of-sheet stock material payed off of the stock roll prior to conversion by the machine into a dunnage product.

16. A method as set forth in claim 15, further comprising the step of feeding the stock material through the separators before the stock roll support frame is returned to its operating position.

17. A method as set forth in claim 13, further comprising the step of using stock material which is biodegradable, recyclable and composed of a renewable resource.

* * * * *

UNITED STATES PATENT AND TRADEMARK OFFICE

CERTIFICATE OF CORRECTION

PATENT NO. : 5,891,010
DATED : April 6, 1999
INVENTOR(S) : Kobben, et al.

It is certified that error appears in the above-identified patent and that said Letters Patent is hereby corrected as shown below:

In claim 1, column 8, line 60, "include" should be --includes--.

In claim 1, column 8, line 63, "units" should be --mounts--.

In claim 8, column 9, line 18, "packaging-surface" should be --packaging surface--, and in line 21, "Its" should be --its--.

In claim 13, column 10, line 15, following "perpendicular", insert --axis-- and in line 25, "rotatable" should be --rotatably--.

In claim 14, column10 ,line 27, after "using" delete ",".

In claim 15, column 10, line 31, "of-sheet" should be --of sheet--.

Signed and Sealed this

Fifteenth Day of February, 2000

*Attest:*

*Attesting Officer*

Q. TODD DICKINSON

*Commissioner of Patents and Trademarks*